US010724160B2

(12) United States Patent
Smissaert et al.

(10) Patent No.: US 10,724,160 B2
(45) Date of Patent: Jul. 28, 2020

(54) METHOD FOR FACE-TO-FACE WEAVING OF FABRICS WITH FIGURE WARP THREADS

(71) Applicant: NV MICHEL VAN DE WIELE, Kortrijk/Marke (BE)

(72) Inventors: Ludo Smissaert, Assebroek (BE); Steven Debaes, Rekkem (BE)

(73) Assignee: NV MICHEL VAN DE WIELE (BE)

( * ) Notice: Subject to any disclaimer, the term of this patent is extended or adjusted under 35 U.S.C. 154(b) by 0 days.

(21) Appl. No.: 15/775,380

(22) PCT Filed: Nov. 10, 2016

(86) PCT No.: PCT/IB2016/001608
§ 371 (c)(1),
(2) Date: May 10, 2018

(87) PCT Pub. No.: WO2017/081530
PCT Pub. Date: May 18, 2017

(65) Prior Publication Data

US 2018/0371652 A1 Dec. 27, 2018

(30) Foreign Application Priority Data

Nov. 10, 2015 (BE) ..... 2015/0263

(51) Int. Cl.
*D03D 27/10* (2006.01)
*D03D 39/16* (2006.01)
*D03D 39/00* (2006.01)

(52) U.S. Cl.
CPC ..... *D03D 39/16* (2013.01); *D03D 27/10* (2013.01); *D03D 2700/12* (2013.01); *D03D 2700/60* (2013.01)

(58) Field of Classification Search
CPC ..... D03D 27/10; D03D 2700/12; D03D 2700/60; D03D 27/06; D03D 39/16
See application file for complete search history.

(56) References Cited

U.S. PATENT DOCUMENTS 395,462 A * 1/1889 Taylor et al. ..... D03D 23/00 139/418
698,743 A * 4/1902 Scholes ..... D03D 23/00 139/418

(Continued)

FOREIGN PATENT DOCUMENTS

BE 1 785 514 A2 5/2007

OTHER PUBLICATIONS

Written Opinion and International Search Report dated Mar. 1, 2017.

*Primary Examiner* — Robert H Muromoto, Jr.
(74) *Attorney, Agent, or Firm* — Fresh IP PLC; Aubrey Y Chen

(57) ABSTRACT

A method for face-to-face weaving of two at least partially pile-free fabrics (I), (II) in which weft threads (101-104), (201-204) are inserted between warp threads (1*a*-14*a*,1*b*-14*b*) of warp thread systems with figure warp threads (1*a*-8*a*),(1*b*-8*b*) that are allocated to respective fabrics (I,II) and are either pattern-determining in that fabric or are incorporated therein, whereby at least one set (1*a*,1*b*), . . . (8*a*,8*b*) of two identical figure warp threads is provided per pair of neighbouring warp thread systems, while the two figure warp threads of each set belong to a different warp thread system (1*a*-14*a*), (1*b*-14*b*) and are allocated to a different fabric (I,II), so that each set of figure warp threads per pair of neighbouring warp thread systems provides a figure warp thread in both fabrics (I,II) to determine the pattern.

25 Claims, 5 Drawing Sheets

(56) References Cited

U.S. PATENT DOCUMENTS 808,976 A * 1/1906 Dornan ..... D03D 11/00 139/412
1,795,157 A 3/1931 Zimmermann
2,060,502 A * 11/1936 Kaufman ..... D03D 27/10 139/398
2,095,382 A * 10/1937 Drobile ..... D03D 27/10 139/21
2,108,046 A * 2/1938 Drobile ..... D03D 27/10 139/397
2,182,610 A * 12/1939 Calonnier ..... D03D 27/10 139/397
3,327,738 A * 6/1967 Sabbe ..... D03D 27/10 139/398
3,519,032 A * 7/1970 Jan ..... D03D 27/10 139/398
4,197,345 A * 4/1980 Worrall ..... D03D 15/00 139/383 R
4,848,412 A * 7/1989 Pittman ..... D03D 13/00 139/383 R
5,398,730 A * 3/1995 Derudder ..... D03D 27/10 139/21
5,465,761 A * 11/1995 Gheysen ..... D03D 27/10 139/21
5,758,697 A * 6/1998 Musha ..... D03D 13/004 139/192
6,173,746 B1 * 1/2001 Debaes ..... D03D 13/00 139/392
6,182,708 B1 * 2/2001 Smissaert ..... D03D 27/10 139/21
6,186,189 B1 * 2/2001 Gheysen ..... D03D 27/10 139/392
6,247,506 B1 * 6/2001 Debaes ..... D03D 13/004 139/402
6,336,475 B2 * 1/2002 Dewispelaere ..... D03D 27/10 139/391
6,343,626 B1 * 2/2002 Demey ..... D03D 27/10 139/37
6,457,489 B2 * 10/2002 Smissaert ..... D03D 27/10 139/21
6,945,280 B2 * 9/2005 Debaes ..... D03D 27/10 139/116.5
7,086,424 B2 * 8/2006 Debaes ..... D03D 27/06 139/20
7,207,355 B2 * 4/2007 Lee ..... D21F 1/0036 139/383 A
7,240,698 B2 * 7/2007 Debaes ..... D03D 27/10 139/102
7,287,552 B2 * 10/2007 Debaes ..... D03D 27/10 139/191
7,337,809 B2 * 3/2008 Vanderjeugt ..... D03C 3/12 139/21
7,395,839 B2 * 7/2008 Debaes ..... D03D 39/16 139/116.5
7,431,055 B2 * 10/2008 Debaes ..... D03D 27/00 139/116.5
7,520,303 B2 * 4/2009 Mertens ..... D03D 27/10 139/102
7,621,297 B2 * 11/2009 Debaes ..... D03D 27/10 139/102
7,644,737 B2 * 1/2010 Mueller ..... D03D 35/00 139/11
7,841,369 B1 * 11/2010 Osborne ..... A41D 13/0012 139/319
7,992,595 B2 * 8/2011 Debaes ..... D03D 27/10 139/102
8,651,150 B2 * 2/2014 Siebert ..... D03D 27/10 139/11
9,410,272 B2 * 8/2016 Siebert ..... D03D 27/10
9,534,323 B1 * 1/2017 Dubey ..... D03D 27/08
9,580,844 B2 * 2/2017 Debaes ..... D03D 39/16
2001/0010236 A1 * 8/2001 Dewispelaere ..... D03D 27/10 139/391
2001/0050112 A1 * 12/2001 Smissaert ..... D03D 27/10 139/383 A
2005/0247367 A1 * 11/2005 Debaes ..... D03D 27/06 139/327
2006/0118196 A1 * 6/2006 Debaes ..... D03D 27/10 139/11
2006/0137758 A1 * 6/2006 Debaes ..... D03D 27/10 139/11
2007/0006932 A1 * 1/2007 Mertens ..... D03D 27/10 139/37

* cited by examiner

METHOD FOR FACE-TO-FACE WEAVING OF FABRICS WITH FIGURE WARP THREADS

This application claims the benefit of Belgian patent application BE-2015/0263, filed Nov. 10, 2015, which is hereby incorporated by reference.

FIELD OF THE DISCLOSURE

This disclosure relates to a method for the production of fabrics which are at least partially pile-free, in which in each consecutive weft insertion cycle on a face-to-face weaving machine, one or more weft threads are inserted into a shed between warp threads of a number of warp thread systems lying alongside one another, in which each warp thread system comprises one or more figure warp threads, in which each figure warp thread is allocated to one of the fabrics, and in which the warp threads are positioned in each shed in such a way that two fabrics are woven above one another with at least one zone in which each figure warp thread corresponding to a desired pattern is either pattern-determining in the fabric to which this figure warp thread is allocated or is incorporated into that fabric in a non-pattern-determining way. This disclosure also relates to a fabric produced using this method.

The term 'pile-free' in the context of this patent application is used to mean the absence of cut pile. The term 'at least partially pile-free fabric' is used to mean a fabric having at least one zone in which no cut pile is present.

This disclosure also relates to a face-to-face weaving machine comprising a number of warp thread systems lying alongside one another, each of which comprising one or more figure warp threads, weft insertion devices provided to insert one or more weft threads into a shed between the warp threads in each consecutive weft insertion cycle, and shed forming devices provided to position the warp threads in each shed and to thereby allocate each figure warp thread to one of the fabrics so that two at least partially pile-free fabrics are woven above one another with at least one zone in which each figure warp thread corresponding to a desired pattern is either pattern-determining in the fabric to which this figure warp thread is allocated or is incorporated into that fabric in a non-pattern-determining way.

The term 'pattern' is used in this patent application as meaning a drawing, a figure or a pattern, or, in the broadest sense, any variation in the appearance of a fabric under the normal conditions of use.

In this patent application, the term 'figure warp thread' is used as meaning any warp thread provided to contribute to the formation of such a pattern on or in a fabric by, for example, running visibly above one or more weft threads at the fabric surface, whether or not forming ribs, or by forming pile loops or cut pile on the fabric, or by combining two or more of these possibilities. A figure warp thread is 'pattern-determining in a fabric' when it contributes to the formation of the pattern on or in the fabric, or is non-pattern-determining when it is incorporated into the fabric and does not contribute to the formation of the pattern under the normal conditions of use of the fabric.

BACKGROUND

A figure warp thread is pattern-determining through its appearance. This can be, for example, due to the colour of the figure warp thread or due to the material from which it is made, or due to the gloss or hairiness or thickness of the figure warp thread, or due to a combination of two or more of these appearance-determining characteristics. Two or more figure warp threads can also run parallel to one another in a fabric, so that the combination of their appearance-determining characteristics is pattern-determining.

'Zone' is used in this patent application in a very general sense to refer to a particular fabric surface, so that this term can mean not only a part of the surface of a fabric, but also the whole surface of a fabric. An at least partially pile-free fabric thus has at least one pile-free zone.

Each warp thread system comprises a number of warp threads, each with a respective function in the fabric, with these functions being repeated in each warp thread system. Often the warp threads per warp thread system are drawn through a respective reed opening between two dents of the weaving reed. We should also emphasise that the meaning of the term warp thread system must not be limited in this sense. The warp threads of the same warp thread system can indeed also be spread over two or more reed openings, or the warp threads of several warp thread systems can be present in the same reed opening.

European patent EP 1072705 B1 describes a method in which a series of warp thread systems is provided on a three rapier face-to-face weaving machine comprising binding warp threads, tension warp threads, rib warp threads and pile warp threads. The rib warp threads and the pile warp threads are used as figure warp threads to make a desired pattern visible on the fabrics. At each weaving cycle, three weft threads are inserted at respective weft insertion levels into a shed between the warp threads. The warp threads are thereby positioned relative to the weft insertion levels in consecutive weaving cycles in such a way that two identical fabrics with a rib structure and cut pile are formed above one another. By using two or more differently coloured rib warp threads for each fabric, a desired colour variation can be created into the rib structure.

In order to be able to use rib warp threads with two different colours in each fabric to produce the desired colour variation using this state-of-the-art method, two differently coloured rib warp threads have to be provided in each warp thread system per fabric, hence a total of four rib warp threads per warp thread system.

For each additional colour required to produce the desired colour variation in the two fabrics, two additional figure warp threads with that colour have to be provided in each warp thread system. The increase in the colour variation in such a fabric thus leads to a significantly higher yarn consumption, and naturally has a negative influence on the yarn consumption, the production costs and the weight of the fabrics.

SUMMARY

An object of some embodiments of this invention is to provide a method for simultaneous production of two at least partially pile-free fabrics with the same pattern on a face-to-face weaving machine that allows fabrics to be produced with a favourable relationship between the colour variation in the patterns created with figure warp threads on the one hand, and said production parameters—yarn consumption, production costs and weight—on the other. In other words, a method with which, by comparison with the existing methods and with the same colour variation in the fabric patterns, a reduction in said production parameters can be achieved, or with which a greater colour variation can be achieved without significant increases in these production parameters.

The above objects may be achieved by providing a method having the characteristics indicated in the first paragraph of this description in which in at least one pair of two warp thread systems lying alongside one another, at least one set of two figure warp threads with the same appearance is provided, whereby the figure warp threads with the same appearance of each set belong to a different warp thread system of the pair and are, respectively, allocated to a different fabric, so that for each set of two figure warp threads with the same appearance, per pair of warp thread systems, a figure warp thread with said appearance is available in both fabrics to determine the pattern in said zones.

With one set of figure warp threads per pair of warp thread systems, one figure warp thread with a certain appearance can already be provided to determine the pattern in each fabric. This is one figure warp thread per warp thread system. With the state-of-the-art methods, two figure warp threads are required therefor per warp thread system.

In order, for example, to produce fabrics using this method in which per fabric a first figure warp thread with a first colour and a second figure warp thread with a second colour are required to realize a desired pattern, one set of two first figure warp threads and one set of two second figure warp threads have to be provided per pair of warp thread systems. Each warp thread system of the pair then has one first and one second figure warp thread. In the first warp thread system, the first figure warp thread is allocated to the top fabric and the second figure warp thread is allocated to the bottom fabric. In the second warp thread system of the pair, this allocation is reversed: the first figure warp thread is allocated to the bottom fabric while the second figure warp thread is allocated to the top fabric. When seen per pair of warp thread systems, both colours are available in both fabrics to be used for determining the pattern.

By providing only two figure warp threads per warp thread system, figure warp threads with two different colours can thus be provided in each fabric for realization of the desired pattern. With the state-of-the-art methods, four figure warp threads are required per warp thread system. In general with some embodiments of the method according to the invention, the number of figure warp threads required per warp thread system is equal to the number of different appearance-determining characteristics (e.g. colours) required per fabric to achieve the desired pattern, while that number is doubled with the state-of-the-art methods.

This method means that a figure warp thread that determines part of the pattern in the top fabric and a figure warp thread with the same appearance that determines a corresponding part of the pattern in the bottom fabric do not lie above one another in the same warp thread system, but are offset relative to one another by one warp thread system. The variation in the appearance of the separately viewed fabrics hardly differs as a result, however, so that the pattern in the fabrics can be regarded as identical.

Using this method, the fabrics are preferably woven so that the sides of the fabric in which the pattern is formed (the pattern sides) are facing towards one another. The method does, however, also allow the fabrics to be woven with their pattern sides facing away from one another, or with the pattern sides of the two fabrics facing upwards or downwards. Even "two-sided fabrics" in which both sides can be used as the visible fabric side, and of which at least one side is a pattern side, can be produced using some embodiments of the method according to this invention.

In a preferred method according to some embodiments of this invention, in at least one pair of two warp thread systems lying alongside one another, at least one of the figure warp threads of said sets is bound alternately into the one and into the other fabric over at least one weft thread, and is then cut between the fabrics so that at least one pile zone is created in each fabric. The term "pile zone" is used in this patent application to mean a zone in which there is cut pile. A pile-free zone then means a zone in which there is no cut pile.

Such a figure warp thread can be made pattern determining by cutting the pile. It is also possible in another way to achieve an additional pattern-determining effect in such a zone in which pile is formed. This can be achieved, for example, by allowing one or more figure warp threads to float on the fabric surface in a pile zone with such pile density that the upright pile legs do not make that fabric surface completely invisible, so that these figure warp threads are visible between the upright pile legs and with their colour or some other appearance-determining characteristic create a kind of background effect.

According to a preferred method, pattern-determining figure warp threads are used in at least one pile-free zone.

When cut pile is formed by a figure warp thread from a set of figure warp threads with the same appearance in each warp thread system of a series of consecutive warp thread systems, then according to some embodiments of this invention these consecutive figure warp threads are allocated alternately to the one and to the other fabric. Since consecutive figure warp threads are thus incorporated into different fabrics when they do not form pile, their first pile leg at the start of the pile formation and their last pile leg at the end of the pile formation shall not be bound in over the same weft thread. As a result, the edges of a pile zone will not form a straight line in the weft direction, but have a jagged course (also referred to as a sawtooth pattern).

If this jagged course at the edges of the pile zones is to be avoided, it is best for the pile formation to provide at least one additional figure warp thread in a number of warp thread systems that does not belong to a set of figure warp threads and that is alternately bound in into the one and the other fabric over at least one weft thread and is then cut between the fabrics so that at least one pile zone is created in each fabric.

By providing a separate figure warp thread in each warp thread system, these warp threads of consecutive warp thread systems are not allocated alternately to the one and the other fabric. Because these separate figure warp threads can be incorporated into the same fabric, the sawtooth pattern is avoided and pile zones with straight edges in the weft direction can be formed.

In such pile zones, too, an additional pattern-determining effect can be achieved, for example by means of figure warp threads floating on the fabric surface that are visible between the upright pile legs and with their colour or some other appearance-determining characteristic create a kind of background effect.

In a very preferred method, said zones are pile-free zones of fabrics with at least one pile zone.

Two or more sets of figure warp threads can be provided per pair of two warp thread systems lying alongside one another, whereby the appearance of the figure warp threads of each set differs from the appearance of the figure warp threads of each other set.

As a result, several appearance-determining characteristics (such as colours) are available in each fabric for determining a pattern. This increases the number of possible variations in the fabrics. The different appearance-determining characteristics (such as colours) are available separately, but so are all possible combinations of two or more of these characteristics.

In a preferred method, an even number of sets of figure warp threads is provided per pair of two warp thread systems lying alongside one another, and an equal number of figure warp threads is allocated to each fabric per warp thread system.

It is thus possible, for example, to provide one set of two first figure warp threads with the same first appearance-determining characteristic and one set of two second figure warp threads with the same second appearance-determining characteristic. In the first warp thread system of the pair, the first and the second figure warp thread are allocated to the top and bottom fabrics, respectively. In the second warp thread system of the pair, this allocation is reversed and the first and the second figure warp thread are allocated to the bottom and top fabrics, respectively.

When seen per pair of warp thread systems, both characteristics are available in both fabrics to be used for determining the pattern. In each warp thread system, the figure warp threads are uniformly distributed between the fabrics so that both fabrics have the same quality and weight.

The figure warp threads of the warp thread systems lying alongside one another are preferably drawn through the reed openings between the dents of the weaving reed in the same order alongside one another. The figure warp threads of the consecutive warp thread systems are preferably brought in the same way into cooperation with the shed forming devices of the weaving machine, and the drawing through the heddle eyelets thus follows the same sequence. This method requires only that the figure warp threads of consecutive warp thread systems are allocated alternately to the one and the other fabric.

In a very preferred method, each warp thread system comprises n figure warp threads with mutually differing appearance, whereby n is an even number and whereby each figure warp thread belongs to a respective set of figure warp threads, and in each pair of a first and a second warp thread system lying alongside one another in the first warp thread system n/2 figure warp threads are allocated to the top fabric and n/2 other figure warp threads are allocated to the bottom fabric, and in the second warp thread system n/2 figure warp threads with the same appearance as the figure warp threads that were allocated to the bottom fabric in the first warp thread system are allocated to the top fabric, and n/2 figure warp threads with the same appearance as the figure warp threads that were allocated to the top fabric in the first warp thread system are allocated to the bottom fabric.

In another very preferred method, n=8 and the eight figure warp threads of each pair of a first and a second warp thread system lying alongside one another are allocated to the fabrics according to one of the following allocation plans, whereby the allocation of each of these eight figure warp threads with first, second, third, . . . eighth appearance is always indicated in each allocation plan for both warp thread systems in the same order by means of a sequence of eight letters T or B, where T indicates the top fabric ('top weave') and B the bottom fabric ('bottom weave'):

| Allocation | First warp thread system | | | | | | | | Second warp thread system | | | | | | | |
|---|---|---|---|---|---|---|---|---|---|---|---|---|---|---|---|---|
| plan | 1 | 2 | 3 | 4 | 5 | 6 | 7 | 8 | 1 | 2 | 3 | 4 | 5 | 6 | 7 | 8 |
| A | T | B | T | B | B | T | B | T | B | T | B | T | T | B | T | B |
| B | T | T | T | T | B | B | B | B | B | B | B | B | T | T | T | T |
| C | T | T | B | B | B | B | T | T | B | B | T | T | T | T | B | B |
| D | B | T | T | B | B | T | T | B | T | B | B | T | T | B | B | T |

According to a particularly interesting method according to some embodiments of this invention, the warp threads are positioned in each shed in such a way that two fabrics are woven above one another with at least one figure warp thread in said zone(s) that runs over at least one weft thread of the respective fabric pattern-determining at the fabric surface.

Numerous variations of these allocation plans are, of course, possible following the principle that per pair of warp thread systems, one figure warp thread of the same set of figure warp threads in the one warp thread system is allocated in each case to the one fabric, and in the other warp thread system of the pair the other figure warp thread of the set of figure warp threads is allocated to the other fabric. An equal number of figure warp threads is preferably allocated to each fabric per warp thread system.

The most preferable allocation plans are the allocation plans where the figure warp threads allocated to the same fabric are spread as far as possible within one pair of warp thread systems. This spread is determined by the drawing through the heddle eyelets. In a typical draw in "centre draw", the eight figure warp threads with the numbering from the above table are drawn in the order (from left to right): 6-8-5-7-3-1-4-2. When the allocation of the figure warp threads according to allocation plan c is viewed in this drawing order from left to right, we have for the first warp thread system B T B T B T B T and then of course T B T B T B T B for the second warp thread system. The spread is ideal here since figure warp threads lying alongside one another are never allocated to the same fabric.

If allocation plan b is followed, we obtain a less favourable spread because the figure warp threads that are allocated to the same fabric are lying directly alongside one another.

A less favourable spread can result in groups of incorporated figure warp threads lying closely alongside one another occurring in the fabrics. This can lead to line formation that is particularly visible on the back side of the fabric. This can be avoided by using a better spread.

When a figure warp thread runs over one or more weft threads at the surface of the fabric (this is called 'floating'), a noticeably pattern-determining effect is obtained in the fabric, particularly if this happens in a pile-free zone.

Two or more figure warp threads can also be allowed to float together over several weft threads at the fabric surface. In order to avoid these parallel figure warp threads from running on top of one another and partially or completely masking one another, these figure warp threads are not allowed to run parallel at the transition from their incorporated state to their floating state and vice versa. The first weft thread and the last weft thread over which the floating part of the one figure warp thread extends should therefore preferably not be the same weft threads as the first and last weft thread, respectively, over which the floating part of the other figure warp thread extends. The first weft thread of the one figure warp thread is then inserted at least one weft insertion cycle later, preferably two weft insertion cycles later, than the first weft thread of the other figure warp thread. The same applies to the last weft threads of the one and the other figure warp thread. As a result, the figure warp threads intersect one another so that they come to lie better alongside one another and there is less chance that they run over one another and mask one another.

Furthermore, according to this method, an additional pattern-determining effect in the weft direction (called a weft effect) can be created by inserting at least one additional weft thread in a number of weft insertion cycles, and by positioning the warp threads in each shed in such a way that two fabrics are woven above one another with one or more additional weft threads running predominantly at the fabric surface in said zone(s) to create a pattern-determining effect in the fabric.

According to another particularly interesting method according to some embodiments of this invention, at least one additional weft thread is inserted in a number of weft insertion cycles, and the warp threads are positioned in each shed in such a way that two fabrics are woven above one another with at least one figure warp thread in said zone(s) running over at least one additional weft thread to form a rib.

The additional weft threads preferably do not form part of the fabrics and run at the fabric surface where they are held by the rib-forming figure warp threads running over them. When their path is fairly long, these additional weft threads can now and then run under and be fixed by a warp thread of the fabric. This results in fabrics in which not only the pattern forming, but also a rib structure, provides a varied aesthetic effect. Such fabrics are referred to as fabrics with a 'sisal look' rib structure.

When the additional weft threads are thicker than the other weft threads of the fabric, these can be used to produce a very noticeable weft effect that also creates a certain relief structure at the fabric surface. The use of thicker additional weft threads to create ribs results in a particularly pronounced rib structure. These effects that are created by the additional weft threads are added to the variation achieved by the pattern forming using the figure warp threads proper.

According to another particularly interesting method, a loop weft thread is inserted in a number of weft insertion cycles, means are provided to keep the loop weft threads at a distance from the other weft threads in the fabrics being created, and the warp threads are positioned in each shed in such a way that two fabrics are woven above one another with at least one figure warp thread in said zone(s) that is bound into the fabric alternately over one or more weft threads and runs over at least one loop weft thread of the concerned fabric, after which the loop weft threads are removed so that the figure warp thread forms pile loops.

Said means for keeping the loop weft threads at a distance from the other weft threads in the fabrics being created are preferably top and bottom lancets that extend during weaving in the warp direction between the two fabrics being created. The loop weft threads are inserted between these top and bottom lancets so that loop weft threads for the top fabric are held at a distance from the top fabric by the top lancets, and loop weft threads for the bottom fabric are held at a distance from the bottom fabric by the bottom lancets.

Such a figure warp thread determines the pattern by forming pile loops. It is also possible to achieve an additional pattern-determining effect in another way in such a zone in which pile loops are formed. This can be, for example, by allowing one or more figure warp threads to float on that fabric surface so that these figure warp threads are visible between the pile loops and with their colour or some other appearance-determining characteristic create a background effect.

The method according to some embodiments of the invention can also be performed in that the warp threads are positioned in each shed in such a way that two fabrics are woven above one another with bound first weft threads on a first level and bound second weft threads on a second level, and with figure warp threads running non-pattern-determining preferably taut between the first and second weft threads.

By preference, two binding warp threads are also provided in each warp thread system per fabric, and these are positioned in such a way that they repeatedly intersect one another and between their consecutive intersections form openings in which a first and a second weft thread are bound in each case.

Each warp thread system preferably also contains at least one tension warp thread per fabric, while the warp threads are positioned in each shed in such a way that two fabrics with bound tension warp threads are woven above one another.

The tension warp threads preferably run taut between said first and second weft threads. The non-pattern-determining figure warp threads incorporated taut into the fabrics can equally also serve as tension warp threads.

According to a special method, a first production phase in which each figure warp thread is allocated to one of the fabrics according to a first allocation plan is followed by a second production phase in which each figure warp thread is allocated to one of the fabrics according to a second allocation plan, and the figure warp threads that are allocated to a different fabric according to the second allocation plan than according to the first allocation plan are pile forming brought to the other fabric between the two production phases.

The first and second allocation plans differ in that at least one of the figure warp threads is allocated to a different fabric in the one allocation plan than in the other allocation plan.

For example, a first pair of fabrics and a second pair of fabrics can be produced in the first and second production phases, respectively, and the figure warp threads that are allocated to a different fabric according to the second allocation plan can form pile in a transition fabric that is later removed.

This transition fabric is, for example, a piece of plain weave.

In a very preferred method according to some embodiments of the invention, the appearance of the figure warp threads is predominantly determined by their colour.

Said objects of this invention may also be achieved by providing a weaving machine having the characteristics indicated in the second paragraph of this description where according to this embodiment of the invention, in at least one pair of two warp thread systems lying alongside one another, at least one set of two figure warp threads with the same appearance is provided, whereby the figure warp threads with the same appearance of each set belong to a different warp thread system of the pair, and the shed forming devices are provided to allocate the two figure warp threads of each set to a different fabric, so that for each set of two figure warp threads with the same appearance, per pair of warp thread systems, a figure warp thread with said appearance is available in both fabrics to determine the pattern in said zones.

The advantages and effects of this weaving machine correspond to, or can be derived from, the explanation given above with respect to the advantages and effects of the method according to embodiments of this invention.

BRIEF DESCRIPTION OF THE DRAWINGS

The invention is now explained in further detail in the following description of five possible weaving methods in which reference numbers are used to refer to the attached FIGS. 1 to 5, each of which presents two schematic cross-sectional views in the warp direction of a face-to-face woven fabric during face-to-face weaving following the method according to this invention, whereby in the two cross-sectional views in each figure, the warp threads of two warp thread systems lying alongside one another are shown in relation to a series of weft threads in each case, and whereby.

DETAILED DESCRIPTION OF EMBODIMENTS

Figure 1:
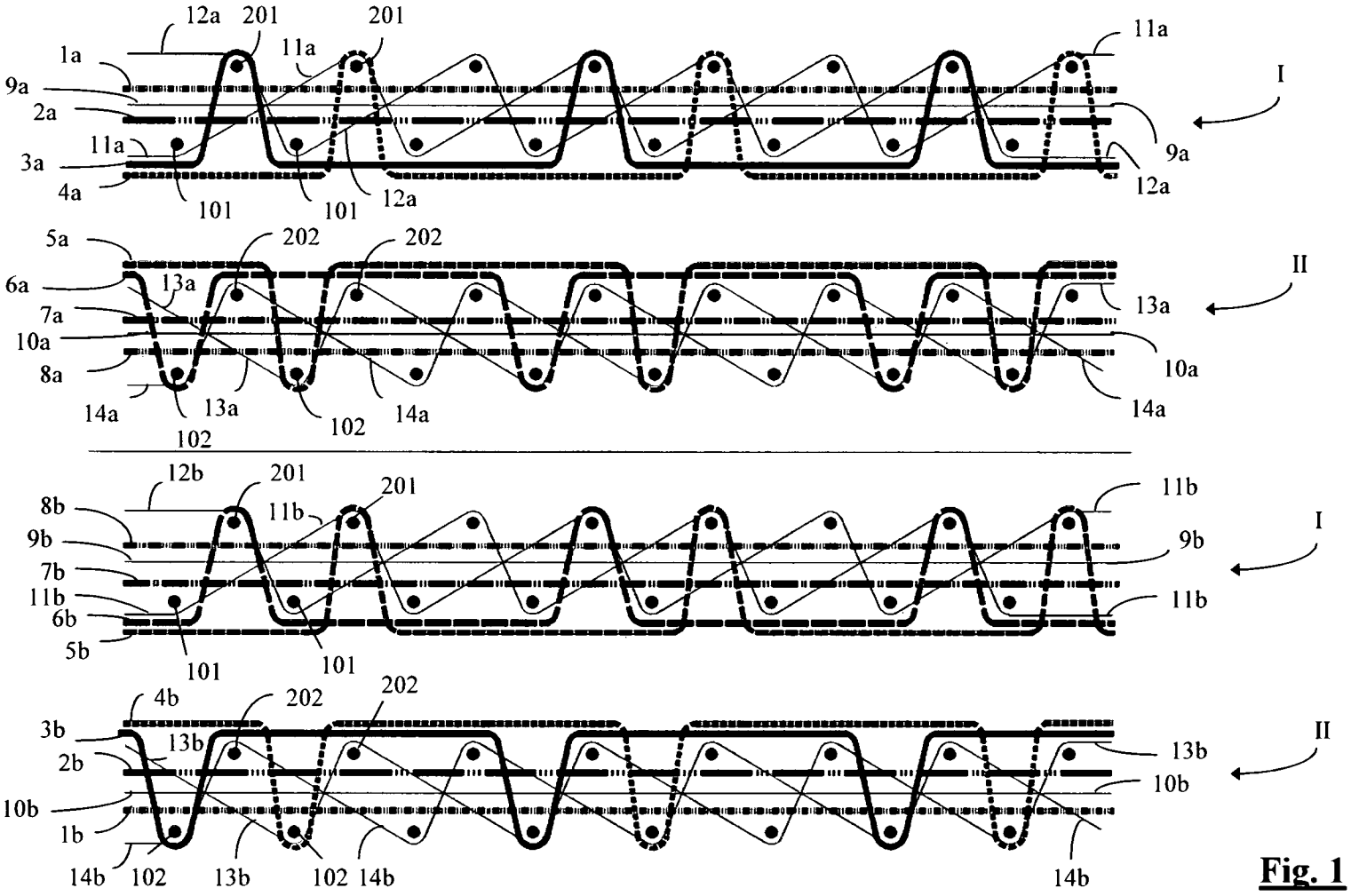
FIG. 1 presents cross-sectional views of a face-to-face woven fabric with floating figure warp threads.

The face-to-face woven fabric according to the figures is produced on a two rapier face-to-face weaving machine (FIGS. 1 and 2) or on a three rapier face-to-face weaving machine (FIGS. 3, 4 and 5), whereby in each consecutive weft insertion cycle, two weft threads (101, 102), (201,202) or three weft threads (101, 102, 103 or 104) (201, 202, 203 or 204) are inserted above one another at respective weft insertion levels into a shed between warp threads (1*a*-14*a*), (1*b*-14*b*) of a series of warp thread systems, whereby each warp thread system comprises the following 14 warp threads:

- Eight figure warp threads (1*a*-8*a*), (1*b*-8*b*) with mutually differing appearance, for example with different colours,
- Two tension warp threads (9*a*, 10*a*), (9*b*, 10*b*), and
- Four binding warp threads (11*a*, 12*a*, 13*a*, 14*a*), (11*b*, 12*b*, 13*b*, 14*b*).

The weaving machine has a jacquard machine for positioning of the figure warp threads (1*a*-8*a*), (1*b*-8*b*). The other warp threads (9*a*, 10*a*), (9*b*, 10*b*), (11*a*, 12*a*, 13*a*, 14*a*), (11*b*, 12*b*, 13*b*, 14*b*) are positioned in each shed, for example by means of weaving frames. These shed forming devices are controlled in such a way that each warp thread (1*a*-14*a*), (1*b*-14*b*) is brought into each shed in such a position relative to the two or three weft insertion levels that the warp threads and the weft threads (101, 102), (201,202) inserted at the levels in the consecutive weft insertion cycles take up the relative positions shown schematically in the figures for the warp threads (1*a*-14*a*),(1*b*-14*b*) of two warp thread systems lying alongside one another. As can be clearly seen in the figures, these warp threads and weft threads thereby form two fabrics (I, II) above one another.

The warp threads (1*a*-14*a*), (1*b*-14*b*) of the different warp thread systems are always drawn through the reed openings between two dents of the weaving reed in the same order. The 14 warp threads of the different warp thread systems are hereby drawn in each case through a respective reed opening and separated from the warp threads of adjacent warp thread systems by the reed dents. As already explained above, the warp threads of each warp thread system can also be spread over two or more reed openings, or warp threads of several warp thread systems can be drawn together through the same reed opening. The drawing sequence of the figure warp threads through the heddle eyelets of the heddles that are positionable by means of the jacquard machine is also the same for the different warp thread systems. The numbering of the figure warp threads has absolutely nothing to do with the order of this draw.

During the face-to-face weaving, the top sides of the fabrics are facing towards one another. The other side of each fabric is referred to as the back side. The top side of a fabric is also referred to in this patent application as a pattern side.

True in all figures is also that the weft threads (101, 201) that are brought in at the top insertion level during consecutive weft insertion cycles (also referred to in this patent application as weaving cycles) are bound into each warp thread system by two binding warp threads (11*a*, 12*a*), (11*b*, 12*b*) so that a top fabric (I) is formed. The weft threads (102, 202) that are brought in at the bottom insertion level during consecutive weft insertion cycles (or weaving cycles) are bound in each time under the top fabric by two other binding warp threads (13*a*, 14*a*), (13*b*, 14*b*) so that a bottom fabric (II) is formed. If three weft threads are inserted above one another in each weaving cycle, there is a top, a middle and a bottom insertion level.

In the top fabric, the one binding warp thread (11*a*) of each warp thread system runs alternately above two weft threads (201, 101) that are inserted at the top insertion level in a first and a following second weaving cycle (the weft threads furthest left in each cross section of the figures are inserted above one another during a first weaving cycle), and under two weft threads (201, 101) that are inserted at the top insertion level in a following third and a following fourth weaving cycle. The other binding warp thread (12*a*) runs alternately under the two weft threads (101, 201) of the first and second weaving cycle and over the two weft threads (101, 201) of the third and fourth weaving cycle. In the bottom fabric (II), this takes place in a corresponding manner for the two binding warp threads (13*a*, 14*a*) relative to the weft threads (102, 202) of the bottom fabric.

In the second warp thread system, the two binding warp threads (11*b*, 12*b*) in the top fabric (I) and the two binding warp threads (13*b*, 14*b*) in the bottom fabric (II) have an identical course relative to the respective weft threads (101, 201), (102, 202) in these fabrics.

As a result, the two binding warp threads (11*a*, 12*a*), (11*b*, 12*b*) and (13*a*, 14*a*), (13*b*, 14*b*), respectively, of each fabric (I, II) intersect after two weaving cycles each time, and in each case two weft threads (101, 201) are bound into the consecutive openings between two intersections of these binding warp threads.

In each warp thread system, a tension warp thread (9*a*), (9*b*) in the top fabric is positioned alternately above the top insertion level and between the top insertion level and the insertion level below (the bottom or middle level, depending on whether there are two or three insertion levels), so that two consecutive weft threads (101, 201) in the top fabric (I) each run respectively above and below the taut tension warp thread (9*a*), (9*b*). In each warp thread system, another tension warp thread (10*a*), (10*b*) in the bottom fabric (II) is positioned alternately below the bottom insertion level and between the bottom insertion level and the insertion level above (the top or middle level, depending on whether there are two or three insertion levels), so that two consecutive weft threads (102, 202) in the bottom fabric (II) each run respectively above and below the taut tension warp thread (10*a*),(10*b*). As a result, the weft threads (101, 201), (102, 202) of each fabric are divided over two levels, whereby alternately a weft thread (102), (201) on the top side and a weft thread (101), (202) on the back side runs relative to the tension warp threads (9*a*),(9*b*),(10*a*),(10*b*) of the fabric. The term 'outer weft' is also used for a weft thread running on the back side of the tension warp threads. A weft thread running on the top side of the tension warp threads is referred to as an 'inner weft'.

The two weft threads that are bound into respective openings between two binding warp threads (11*a*, 12*a*), (11*b*, 12*b*); (13*a*, 14*a*), (13*b*, 14*b*) are each time bound in at different levels in the respective fabric.

The pattern is formed in these fabrics according to the different figures by means of figure warp threads that float on the fabric surface (FIGS. 1, 2 and 3), form cut pile (FIGS. 2, 3 and 5), form pile loops (FIG. 3), or form ribs (FIGS. 4 and 5) or by combining several of these possibilities in the same fabric.

In all the methods, four figure warp threads (1*a*-4*a*) with mutually differing colours are allocated to the top fabric (I) and four other figure warp threads (5*a*-8*a*) with four other mutually differing colours are allocated to the bottom fabric (II) in the first warp thread system (the top system in the figures). The figure warp threads allocated to a fabric are incorporated into this fabric when they are non-pattern-determining.

In the second warp thread system (the bottom system in the figures), four figure warp threads (1*b*-4*b*) with the same respective mutually differing colours as the four figure warp threads that were allocated to the top fabric (I) in the first warp thread system are now allocated to the bottom fabric. Vice versa, four figure warp threads (5*b*-8*b*) with the same respective mutually differing colours as the four figure warp threads that were allocated to the bottom fabric (II) in the first warp thread system are then allocated to the top fabric (I). As a result and seen over the two warp thread systems, eight colours are now available in each fabric to be used as pattern-determining figure warp thread.

In other words, according to all the figures there are two warp thread systems (1*a*-14*a*), (1*b*-14*b*) lying alongside one another in which there is a total of eight sets of two identical figure warp threads (1*a*,1*b*), (2*a*,2*b*), (3*a*,3*b*), (4*a*,4*b*), (5*a*; 5*b*), (6*a*,6*b*), (7*a*,7*b*), (8*a*,8*b*), whereby the colour of each set of figure warp threads differs from the colour of the other sets of figure warp threads, and whereby the two figure warp threads of each set belong to the first and the second warp thread system, respectively, and are also allocated to a different fabric. With eight figure warp threads per warp thread system, per pair of warp thread systems lying alongside one another, eight colours are made available per fabric for the formation of a pattern in the fabrics.

The pattern in the fabrics in FIG. 1 is determined in that on the top side of each fabric in each warp thread system, two figure warp threads (3*a*),(4*a*);(5*a*),(6*a*); (3*b*),(4*b*);(5*b*), (6*b*) have several parts that run (float) over a number of weft threads at the fabric surface.

This pattern formation for one floating part of each pattern-determining figure warp thread (3*a*), (4*a*) in the top fabric (I) is explained in detail below.

In the first warp thread system, in the top fabric (I), a figure warp thread (3*a*) with a first colour runs on the fabric surface over the weft threads (101) on the pattern side that are inserted in the third, fifth and seventh weaving cycle, and a figure warp thread (4*a*) with a second colour runs on the fabric surface over the weft threads (101) on the pattern side that are inserted in the fifth, seventh and ninth weaving cycle.

As far as necessary it should be pointed out that the weft threads shown in the figures vertically above one another are each inserted during the same weaving cycle, and that the weft threads of the consecutive weaving cycles are shown in order from left to right in the figures.

In the second warp thread system, in the top fabric (I), a figure warp thread (6*b*) with a third colour runs on the fabric surface over the weft threads (101) on the pattern side that are inserted in the third, fifth and seventh weaving cycle, and a figure warp thread (4*a*) with a fourth colour runs on the fabric surface over the weft threads (101) on the pattern side that are inserted in the fifth, seventh and ninth weaving cycle.

The figure warp threads are bound over a weft thread (201) on the back side of the fabric (I) immediately before they start to float and immediately after floating.

These two figure warp threads are prevented from running parallel at the transition from their incorporated state to their floating state and vice versa. The one figure warp thread (3*a*),(6*b*) runs on the fabric surface over the weft threads of the third to seventh weaving cycle, while the other figure warp thread (4*a*), (5*b*) runs on the fabric surface over the weft threads of the fifth to ninth weaving cycle. As a result, the figure warp threads intersect one another so that they come to lie better alongside one another and there is less chance that they run over one another and mask one another.

The two figure warp threads (3*b*, 4*b*) of the second warp thread system with the same colours as the figure warp threads (3*a*, 4*a*) inserted into the first warp thread system to float on the fabric surface of the top fabric (I) float in the second warp thread system in the same manner on the fabric surface of the bottom fabric (II). The two figure warp threads (5*b*, 6*b*) with the same colours as the figure warp threads (5*a*, 6*a*) inserted into the first warp thread system to float on the fabric surface of the bottom fabric (II) float in the second warp thread system also in the same manner on the fabric surface of the top fabric (I).

In FIG. 1 it is easy to follow how other parts of figure warp threads contribute to the forming of the pattern in the top and bottom fabric.

The figure warp threads that do not participate in the forming of the pattern are incorporated taut into the fabric to which they have been allocated and run together with the tension warp threads (9*a*, 10*a*), (9*b*, 10*b*) between the two levels in which the weft threads are bound into the fabrics.

Figure 2:
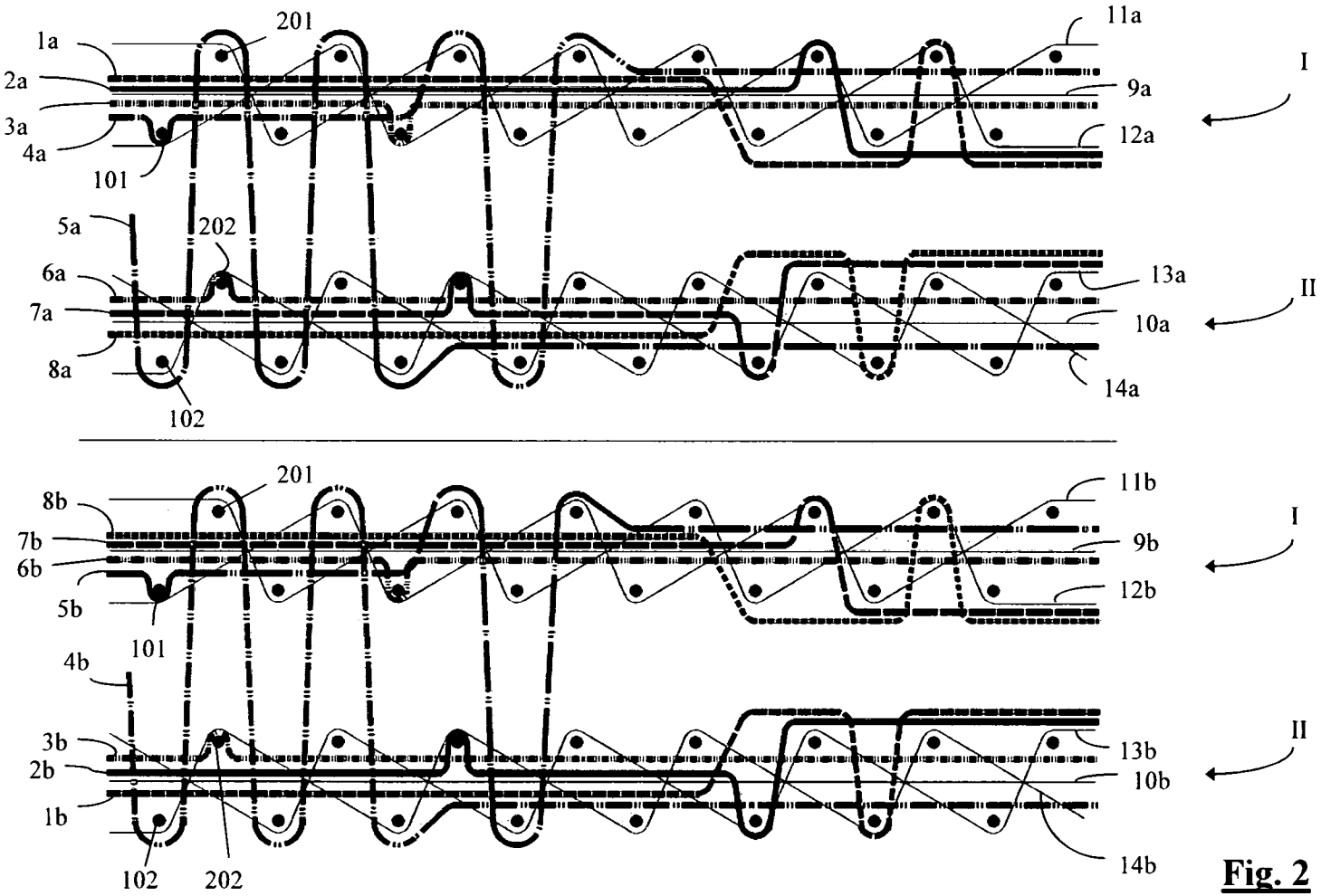
FIG. 2 presents cross-sectional views of a face-to-face woven fabric with a zone in which cut pile is formed and a zone with floating figure warp threads.

In the method illustrated in FIG. 2, a pattern is formed on a right portion of the fabrics with two floating figure warp threads (1*a*), (2*a*) that run over several weft threads (101) on the fabric surface as described above.

In the first warp thread system, a figure warp thread (5*a*) with a first colour that is allocated to the bottom fabric is bound, from the first weaving cycle in consecutive weaving cycles, alternately over an outer weft (102) of the bottom fabric (II) and an outer weft (201) of the top fabric (I), and from the weft thread (102) of the fifth weaving cycle in the bottom fabric (II) is incorporated into this bottom fabric. A figure warp thread (4*a*) with a second colour that is allocated to the top fabric (I) is first incorporated into the top fabric (I) and then runs successively over the outer weft (201) of the sixth weaving cycle in the top fabric (I), the outer weft (102) of the seventh weaving cycle in the bottom fabric (II) and the outer weft (201) of the eighth weaving cycle in the top fabric (I) and is then incorporated back into the top fabric (I).

In the second warp thread system, a figure warp thread (4*b*) with the second colour that is now allocated to the bottom fabric (II) is bound, from the first weaving cycle in consecutive weaving cycles, alternately over an outer weft (102) of the bottom fabric and an outer weft (201) of the top fabric (I), and from the weft thread (102) of the fifth weaving cycle in the bottom fabric (II) is incorporated into this bottom fabric (II). A figure warp thread (5*b*) with the first colour that is now allocated to the top fabric (I) is first incorporated into the top fabric (I) and then runs successively over the outer weft (201) of the sixth weaving cycle in the top fabric (I), the outer weft (102) of the seventh weaving cycle in the bottom fabric (II) and the outer weft (201) of the eighth weaving cycle in the top fabric and is then incorporated back into the top fabric (I).

The figure warp threads (5*a*), (4*a*), (4*b*), (5*b*) running between the two fabrics (I, II) are then cut between the fabrics so that upright pile legs are formed on the fabrics (cut pile).

The cut pile is formed in the warp thread systems lying alongside one another alternately with warp threads of a first colour and a second colour. In this way the appearance of the zone with cut pile is determined by a mixing effect of different colours. By making use of this mixing effect, a sharp demarcation of this zone is also possible. The first and also the last pile leg of this zone are indeed each bound over the same weft thread.

The sawtooth pattern is prevented in that the figure warp threads that form a zone with cut pile are each allocated to the same fabric in the consecutive warp thread systems, and hence bound in at the edges of the pile zone into the same fabric over the same weft thread. The pile zone is formed by a combination of two different coloured figure warp threads (5*a*), (4*b*) and (4*a*), (5*b*). The pile zone exhibits a mixing effect determined by the colour combination. This allows a pile zone with a straight demarcation to be produced (without a sawtooth pattern) because the first and the last pile leg of each pile-forming figure warp thread of the warp thread systems are bound over the same weft thread. This last pile leg can have the one or the other colour, depending on the fabric and the warp thread system in question.

Some figure warp threads (3*a*), (6*a*), a relatively long section of which is not pattern-determining and is thus incorporated into the fabric to which they are allocated, are occasionally laid over one weft thread (101), (202) on the pattern side. These figure warp threads can be visible at this point from above the fabrics and are thus to a limited extent pattern-determining.

Figure 3:
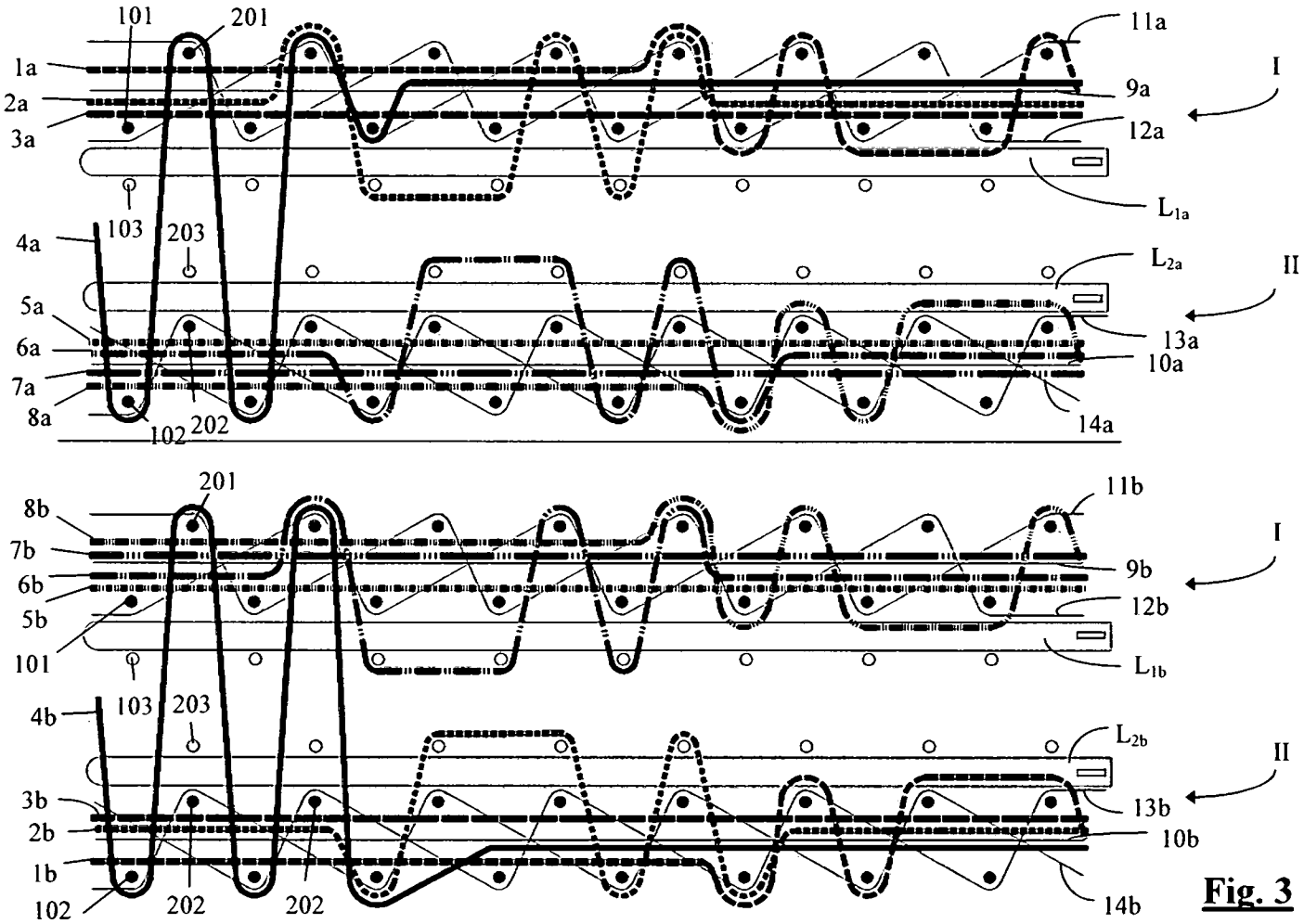
FIG. 3 presents cross-sectional views of a face-to-face woven fabric with a zone in which cut pile is formed, a zone in which pile loops are formed and a zone with floating figure warp threads.

In the method according to FIG. 3, a top lancet ($L_{1a}$), ($L_{1b}$) and a bottom lancet ($L_{2a}$), ($L_{2b}$) is provided in each warp thread system between the two fabrics being created during weaving. The face-to-face weaving machine is a three rapier weaving machine with a middle rapier that inserts a loop weft thread (103), (203) into a middle insertion level during the consecutive weaving cycles. The top and the bottom rapier each insert weft threads in a top and bottom insertion level, respectively, which together with the binding warp threads and the tension warp threads form a top and a bottom fabric as explained above.

The pattern is formed in the fabrics from left to right by means of cut pile, pile loops and figure warp threads running on the fabric surface.

In the first warp thread system, a figure warp thread (4*a*) with a first colour that is allocated to the top fabric is alternately bound over an outer weft (102) of the bottom fabric (II) and over an outer weft (201) of the following weaving cycle into the top fabric (I). From the outer weft (201) of the fourth weaving cycle in the top fabric, this figure warp thread is incorporated into the top fabric.

In the second warp thread system, a figure warp thread (4*b*) with the first colour that is now allocated to the bottom fabric is alternately bound over an outer weft (102) of the bottom fabric (II) and over an outer weft (201) of the following weaving cycle into the top fabric (I). From the outer weft (102) of the fifth weaving cycle in the bottom fabric (II), this figure warp thread (4*b*) is incorporated into the bottom fabric.

Because these figure warp threads (4*a*),(4*b*) are incorporated into different fabrics, the figure warp thread (4*b*) that is allocated to the bottom fabric forms one pile leg more than the figure warp thread (4*a*) allocated to the top fabric. The first figure warp thread (4*b*) must indeed return from the fourth outer weft (201) in the top fabric (I) to the bottom fabric (II) in order to be incorporated there, and the other figure warp thread (4*a*) does not. Because the transition between pile formation and non-pile-forming incorporation (and vice versa) does not take place the same in the consecutive warp thread systems, the edges of a pile zone running in the weft direction have a more or less jagged course.

To the right of this pile zone, other figure warp threads (2*a*), (6*a*); (6*b*), (2*b*) are used to create pile loops in both fabrics. For this, in the first warp thread system a figure warp thread (2*a*) with a first colour allocated to the top fabric is allowed to run immediately after binding over the outer weft (201) of the fourth weaving cycle, first forming a loop over two loop weft threads (103) of consecutive weaving cycles, this figure warp thread (4*a*) is then allowed to bind over an outer weft (201) of the following weaving cycle and then to run back forming a pile loop over one loop weft thread (103) of the following weaving cycle, to allow it to finally run taut after binding over an outer weft (201) into the top fabric between the weft threads bound on two levels.

In an identical manner, but one weaving cycle later, a figure warp thread (6*a*) with a second colour allocated to the bottom fabric is allowed to run in the bottom fabric, first forming a pile loop over two pile weft threads, and immediately thereafter forming a pile loop over one loop weft thread before being incorporated into the top fabric.

In the second warp thread system, exactly the same happens, but the pile loops in the top fabric are now produced with a figure warp thread (6*b*) with the second colour allocated to the top fabric, while the pile loops in the bottom fabric are now produced with a figure warp thread (2*b*) with the first colour allocated to the bottom fabric. The colours are thus reversed. This shows that when seen per pair of warp thread systems, each different colour is available in both fabrics, although only one figure warp thread per colour is provided per warp thread system.

To the right of the zone where pile loops are formed, a zone is formed in which other figure warp threads (1*a*),(8*a*); (8*b*),(1*b*) are pattern-determining since they float over one or more weft threads (101),(202) at the fabric surface. In the first warp thread system in the top and bottom fabric respectively, a figure warp thread (1*a*) with a first colour allocated to the top fabric and a figure warp thread (8*a*) with a second colour allocated to the bottom fabric are used for this.

In the second warp thread system, the colours are reversed: in the top and bottom fabric respectively, a figure warp thread (8*b*) with the second colour allocated to the top fabric and a figure warp thread (1*b*) with the first colour allocated to the bottom fabric are used.

Figure 4:
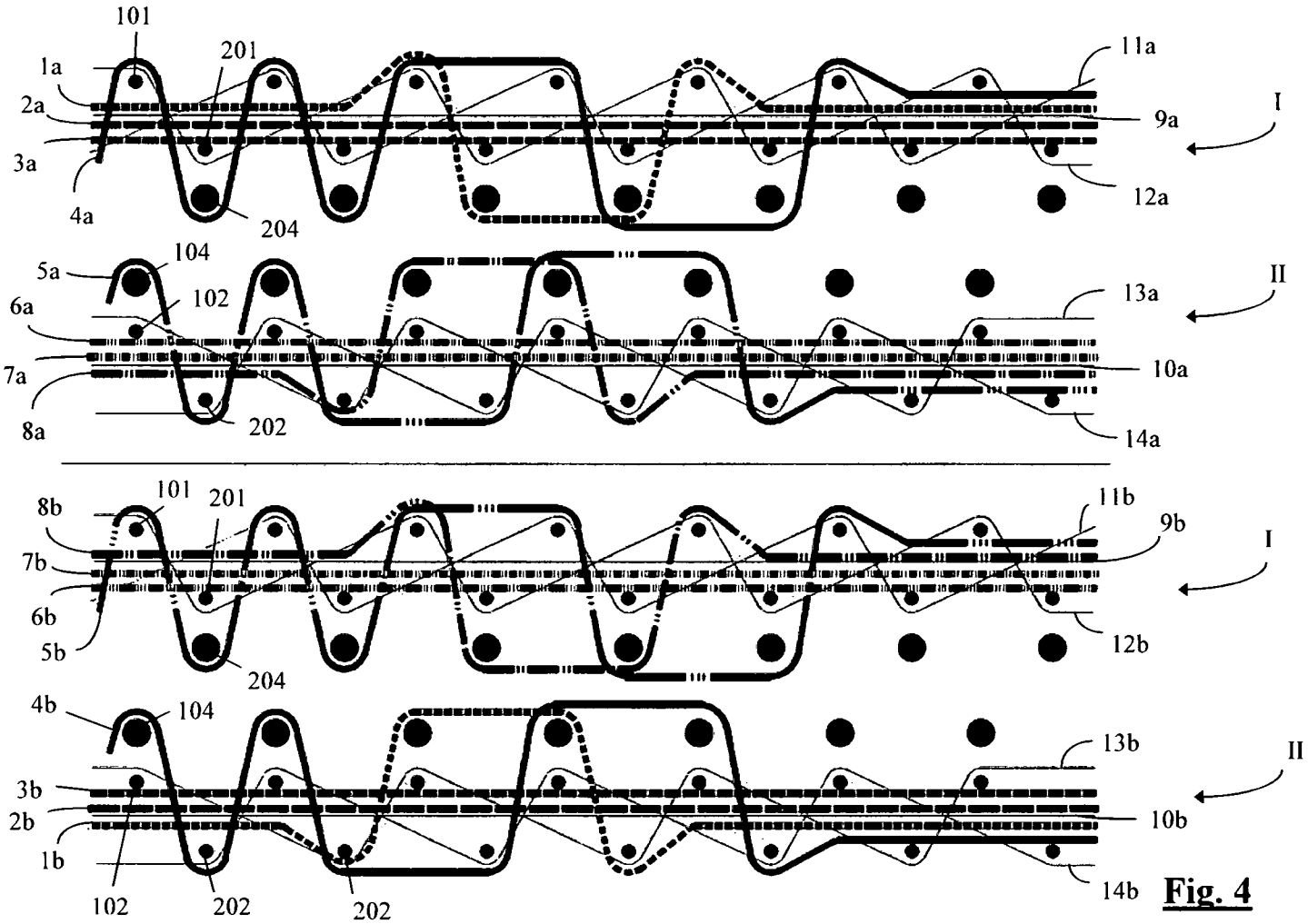
FIG. 4 presents cross-sectional views of a face-to-face woven fabric with a zone in which ribs are formed over additional weft threads, and a zone in which a weft effect is created with additional weft threads.

In the method according to FIG. 4, a three rapier face-to-face weaving machine is used, whereby the middle rapier inserts an additional weft thread (104), (204) at a middle insertion level in the consecutive weaving cycles. The top and the bottom rapier each insert weft threads in a top and bottom insertion level, respectively, that together with the binding warp threads (11*a*, 12*a*), (13*a*,14*a*), (11*b*,12*b*), (13*b*, 14*b*) and the tension warp threads (9*a*, 10*a*), (9*b*, 10*b*) form a top (I) and a bottom (II) fabric as explained above. The additional weft threads (104),(204) are thicker than the other weft threads and run on the top sides of the fabrics facing towards one another and are not bound into the fabrics by binding warp threads.

Here a zone with a rib structure is created in which figure warp threads (1*a*),(4*a*), (5*b*),(8*b*); (5*a*),(8*a*), (1*b*),(4*b*) run over the thicker additional weft threads (104), (204) to form ribs.

For this, a figure warp thread (4*a*) with a first colour allocated to the top fabric is allowed to run alternately over an outer weft (101) of the top fabric (I) and a thicker additional weft thread (204) in the first warp thread system. After producing two ribs, this figure warp thread is incorporated from the outer weft of the fifth weaving cycle into the back side of the top fabric (I). This figure warp thread is furthermore used again to produce a wider rib over the thicker weft threads (204) that are inserted in the eighth and tenth weaving cycles, after which the figure warp thread (4*a*) is bound over an outer weft (101), and further is incorporated running taut between the weft threads (101),(201) bound in at two levels.

In the same way, a second figure warp thread (1*a*) with a second colour allocated to the top fabric is allowed to form a wider rib in the top fabric (I) over the thicker weft threads (204) inserted in the sixth and eighth weaving cycles.

In an identical manner, a figure warp thread (5*a*) with a third colour allocated to the bottom fabric is first allowed to form two ribs in the bottom fabric (II) over the thicker weft threads (104) inserted in the first and third weaving cycle, and to then form a wider rib over the weft threads (104) inserted in the seventh and ninth weaving cycle, and a figure warp thread (8*a*) with a fourth colour allocated to the bottom fabric is also allowed to form a wider rib over the weft threads (104) inserted in the fifth and seventh weaving cycle.

In the second warp thread system, exactly the same happens, but the ribs in the top fabric (I) are now produced with figure warp threads (5*b*), (8*b*) with the third and fourth colour, respectively, allocated to the top fabric (I), while the ribs in the bottom fabric are now produced with figure warp threads (4*b*), (1*b*) with the first and second colours, respectively, allocated to the bottom fabric (II). The colours are thus reversed. Per pair of warp thread systems, each different colour is available in both fabrics.

In a zone on the right side of the cross-sectional views shown in FIG. 4, the thicker weft threads (104),(204) are not masked by figure warp threads, so that these run clearly visibly on the fabric surface and can create an additional pattern-determining effect in the fabrics with their colour and thickness.

Figure 5:
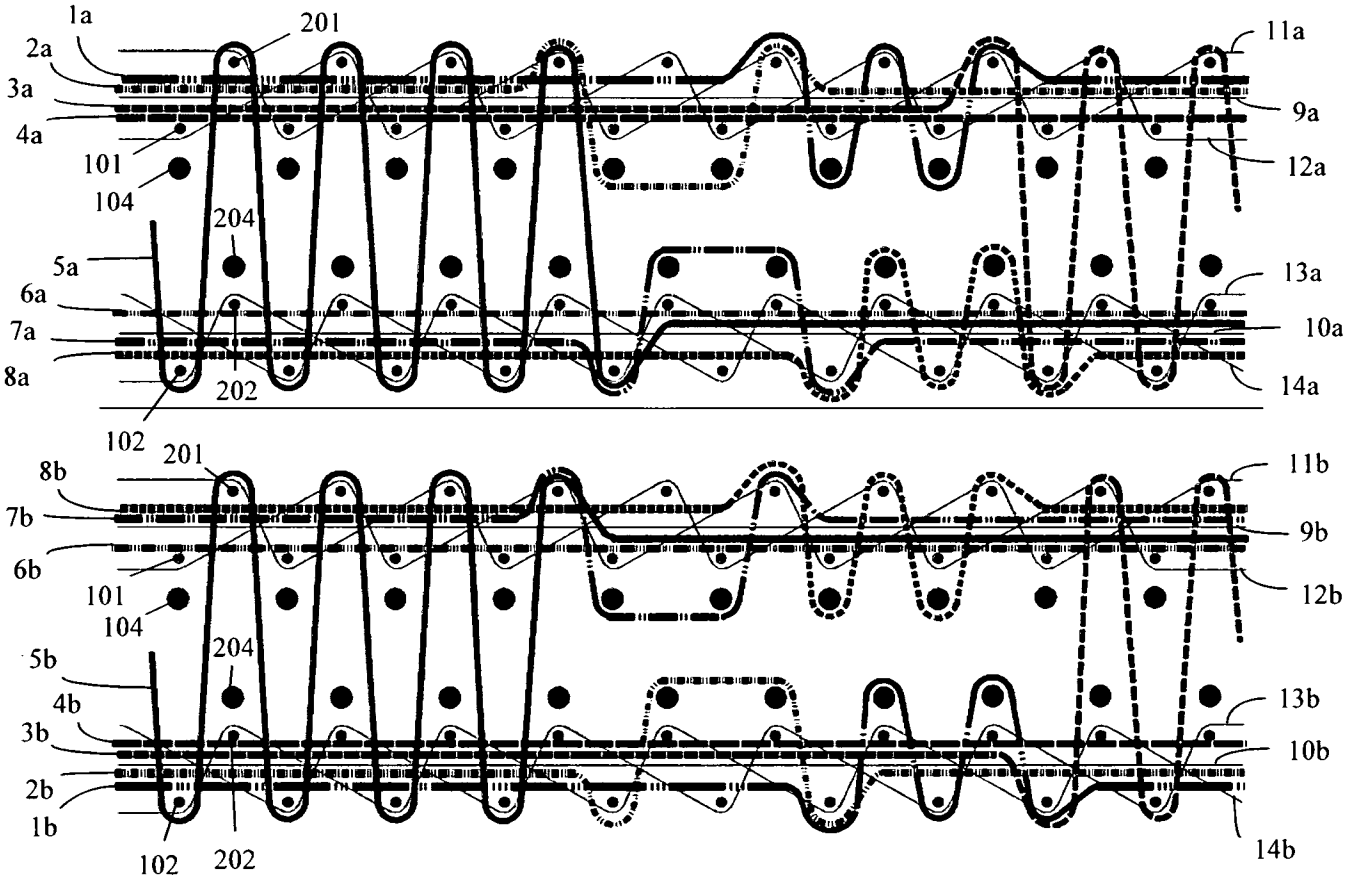
FIG. 5 presents cross-sectional views of a face-to-face woven fabric with two zones in which cut pile and a weft effect created by means of additional weft threads are formed, and a zone lying between these two zones in which ribs are formed over additional weft threads.

In the method according to FIG. 5, a three rapier face-to-face weaving machine is also used, whereby the middle rapier inserts an additional thicker weft thread (104), (204) in the consecutive weaving cycles as in the method according to FIG. 4.

Two pile zones with cut pile are formed in the fabric with an intermediate zone where ribs are formed in the manner described by reference to FIG. 4. The ribs are formed in the top fabric using figure warp threads (2*a*),(1*a*) with a first and a second colour, respectively, and in the bottom fabric using figure warp threads (7*a*),(8*a*) with a third and a fourth colour, respectively. In the second warp thread system, these colours are reversed.

In the left pile zone, a figure warp thread (5*a*) with a certain colour allocated to the top fabric is bound in alternately over an outer weft (102) of the top fabric (I) and over an outer weft of the bottom fabric (II) in the first warp thread system. In the second warp thread system, a figure warp thread (5*b*) with the same colour that now is allocated to the top fabric is alternately bound into the top fabric (I) over an outer weft (102) of the bottom fabric (II) and over an outer weft of the top fabric (I). Because these figure warp threads are incorporated alternately into the top fabric and into the bottom fabric in consecutive warp thread systems, the demarcation of the pile zone is not perfectly straight (sawtooth pattern) as explained above by reference to FIG. 3.

In the right pile zone in FIG. 5, pile is formed in the same way in the first warp thread system by a figure warp thread (3*a*) with a certain colour allocated to the top fabric, and in the second warp thread system pile is formed by a pile warp thread with the same colour allocated to the bottom fabric. A sawtooth pattern is formed again here. The figure warp threads running between the two fabrics are then cut between the two fabrics so that upright pile legs or cut pile are formed on the fabrics.

Sawtooth forming can be prevented by the use of a method according to FIG. 2 or by providing a separate figure warp thread in each warp thread system for the formation of cut pile, whereby the respective separate figure warp threads are always incorporated into the same fabric by the consecutive warp thread systems.

Depending on the pile density and the masking capacity of the figure warp threads that form cut pile, the additional thicker weft threads (104), (204) are more or less visible between the pile legs of the fabrics and form a background effect in these pile zones.

Finally we should emphasise that according to some embodiments of this invention, fabrics can be woven with a particularly large variation in appearance in relation to the number of figure warp threads per warp thread system, whereby by preference it is not only the appearance (such as the colour) of the figure warp threads themselves that provide the variation, but also the variation in the fabric structure, such as i.a. the presence of floating figure warp threads or a rib structure, pile loops or cut pile produced by means of these figure warp threads, or by a combination of two or more of these possibilities, whether or not in combination with a weft effect.

The invention claimed is:

1. A method for the production of fabrics which are at least partially pile-free, comprising:

in each consecutive weft insertion cycle on a face-to-face weaving machine, inserting one or more weft threads into a shed between warp threads of a number of warp thread systems lying alongside one another, wherein each warp thread system, comprises one or more figure warp threads and each figure warp thread is allocated to one of the fabrics, positioning the warp threads in each shed in such a way that two fabrics are woven above one another with at least one zone in which each figure warp thread corresponding to a desired pattern is either pattern-determining in the fabric to which this figure warp thread is allocated or is incorporated into that fabric in a non-pattern-determining way, wherein in at least one pair of two warp thread systems lying alongside one another, providing two or more sets of two figure warp threads with the same appearance, the appearance of the figure warp threads of each set in the two or more sets being different form the appearance of the figure warp threads of each other set in the two or more sets, whereby the figure warp threads with the same appearance of each set belong to a different warp thread system of the pair and are, respectively, allocated to a different fabric, so that for each set of two figure warp threads with the same appearance, per pair of warp thread systems, a figure warp thread with said appearance is available in both fabrics to determine the pattern in said zones.

2. The method for the production of fabrics according to claim 1, further comprising, in at least one pair of two warp thread systems lying alongside one another, binding at least one of the figure warp threads of said sets alternately into the one and into the other fabric over at least one weft thread, and then cutting the at least one of the figure warp threads between the fabrics so that at least one pile zone is created in each fabric.

3. The method for the production of fabrics according to claim 1, characterized in that a number of warp thread systems comprise at least one additional figure warp thread that does not belong to a set of figure warp threads and alternately binding the at least one additional figure warp thread into the one and the other fabric over at least one weft thread and then cutting the at least one additional figure warp thread between the fabrics so that at least one pile zone is created in each fabric.

4. The method for the production of fabrics according to claim 2, characterized in that two fabrics are woven above one another with at least one pile-free zone in which each figure warp thread, corresponding to a desired pattern, is either pattern-determining in the fabric or is incorporated into the fabric in a non-pattern-determining way, while each fabric further comprises at least one pile zone.

5. The method for the production of fabrics according to claim 1, characterized in that an even number of sets of figure warp threads is provided per pair of two warp thread systems lying alongside one another, and that an equal number of figure warp threads is allocated to each per warp thread system.

6. The method for the production of fabrics according to claim 1, characterized in that the figure warp threads of the warp thread systems lying alongside one another are drawn through the weaving reed in the same order alongside one another.

7. The method for the production of fabrics according to claim 1, characterized in that each warp thread system comprises n figure warp threads with mutually differing appearance, whereby n is an even number and whereby each figure warp thread belongs to a respective set of figure warp threads, and in each pair of a first and a second warp thread system lying alongside one another, in the first warp thread system, n/2 figure warp threads are allocated to the top fabric, and n/2 other figure warp threads are allocated to the bottom fabric, and in the second warp thread system, n/2 figure warp threads with the same appearance as the figure warp threads that were allocated to the bottom fabric in the first warp thread system are allocated to the top fabric, and n/2 figure warp threads with the same appearance as the figure warp threads that were allocated to the top fabric in the first warp thread system are allocated to the bottom fabric.

8. The method for the production of fabrics according to claim 7, characterized in that n=8 and that the eight figure warp threads of each pair of a first and a second warp thread system lying alongside one another are allocated to the fabrics according to one of the following allocation plans, whereby the allocation of each of these eight figure warp threads with first, second, third, . . . eighth appearance is always indicated in each allocation plan for both warp thread systems in the same order by means of a sequence of eight letters T or B, where T indicates the top fabric and B the bottom fabric:

| Allocation | First warp thread system | | | | | | | | Second warp thread system | | | | | | | |
|---|---|---|---|---|---|---|---|---|---|---|---|---|---|---|---|---|
| plan | 1 | 2 | 3 | 4 | 5 | 6 | 7 | 8 | 1 | 2 | 3 | 4 | 5 | 6 | 7 | 8 |
| A | T | B | T | B | B | T | B | T | B | T | B | T | T | B | T | B |
| B | T | T | T | T | B | B | B | B | B | B | B | B | T | T | T | T |
| C | T | T | B | B | B | B | T | T | B | B | T | T | T | T | B | B |
| D | B | T | T | B | B | T | T | B | T | B | B | T | T | B | B | T. |

9. The method for the production of fabrics according to claim 1, further comprising positioning the warp threads in each shed in such a way that two fabrics are woven above one another with at least one figure warp thread in said zone(s) running pattern-determining over at least one weft thread of the respective fabric at the fabric surface.

10. The method for the production of fabrics according to claim 1, further comprising inserting at least one additional weft thread in a number of weft insertion cycles, and positioning the warp threads in each shed in such a way that two fabrics are woven above one another with one or more additional weft threads in said zone(s) running predominantly at the fabric surface to create a pattern-determining effect in the fabric.

11. The method for the production of fabrics according to claim 10, further comprising inserting at least one additional weft thread in a number of weft insertion cycles, and positioning the warp threads in each shed in such a way that two fabrics are woven above one another with at least one figure warp thread in said zone(s) running over at least one additional weft thread to form a rib.

12. The method for the production of fabrics according to claim 10, characterized in that the additional weft threads are thicker than the other weft threads of the fabric.

13. The method for the production of fabrics according to claim 1, further comprising inserting a loop weft thread in a number of weft insertion cycles, providing distancers to keep the loop weft threads at a distance from the other weft threads in the fabrics being created, and positioning the warp threads in each shed in such a way that two fabrics are woven above one another with at least one figure warp thread in said zone(s) that is bound into the fabric alternately over one or more weft threads and runs over at least one loop weft thread of the fabric in question, and removing the loop weft threads so that the figure warp thread forms pile loops.

14. The method for the production of fabrics according to claim 1, characterized in that the warp threads are positioned in each shed in such a way that two fabrics are woven above one another with bound first weft threads on a first level and bound second weft threads on a second level, and with figure warp threads that are non-pattern-determining running between the first and the second weft threads.

15. The method for the production of fabrics according to claim 1, characterized in that the warp thread systems contain at least one tension warp thread per fabric, and that the warp threads are positioned in each shed in such a way that two fabrics with bound tension warp threads are woven above one another.

16. The method for the production of fabrics according to claim 1, further comprising in a first production phase allocating each figure warp thread to one of the fabrics according to a first allocation plan, followed by allocating in a second production phase each figure warp thread to one of the fabrics according to a second allocation plan, wherein the figure warp threads that are allocated to a different fabric according to the second allocation plan than according to the first allocation plan are pile forming brought to the other fabric between the two production phases.

17. The method for the production of fabrics according to claim 16, characterized in that a first pair of fabrics and a second pair of fabrics are produced in the first and the second production phases, respectively, further comprising allowing the figure warp threads that are allocated to a different fabric according to the second allocation plan to form pile in a transition fabric and later removing the transition fabric.

18. The method for the production of fabrics according to claim 1, characterized in that the appearance of the figure warp threads is predominantly determined by their color.

19. A face-to-face weaving machine comprising a number of warp thread systems, lying alongside one another, each of which comprising one or more figure warp threads, weft insertion devices provided to insert one or more weft threads into a shed between the warp threads in each consecutive weft insertion cycle, and shed forming devices provided to position the warp threads in each shed and to thereby allocate each figure warp thread to one of the fabrics, so that two at least partially pile-free fabrics are woven above one another with at least one zone in which each figure warp thread corresponding to a desired pattern is either pattern-determining in the fabric to which this figure warp thread is allocated or is incorporated into that fabric in a non-pattern-determining way, wherein in at least one pair of two warp thread systems lying alongside one another, two or more sets of two figure warp threads with the same appearance are provided, the appearance of the figure warp threads of each set in the two or more sets being different from appearance of the figure warp threads of each other set in the two or more sets, whereby the figure warp threads with the same appearance of each set belong to a different warp thread of the pair, and the shed forming devices are provided to allocate the two figure warp threads of each set to a different fabric, so that for each set of two figure warp threads with the same appearance, per pair of warp thread systems, a figure warp thread with said appearance is available in both fabrics to determine the pattern in said zones.

20. The face-to-face weaving machine according to claim 19, characterized in that an even number of sets of figure warp threads are provided per pair of two warp thread systems lying alongside one another, and that an equal number of figure warp threads is allocated to each fabric per warp thread system.

21. The face-to-face weaving machine according to claim 19, characterized in that the figure warp threads of the warp thread systems lying alongside one another are drawn through the weaving reed in the same order alongside one another.

22. The face-to-face weaving machine according to claim 19, characterized in that each warp thread system comprises n figure warp threads with mutually differing appearance, whereby n is an even number and whereby each figure warp thread belongs to a respective set of figure warp threads, and that in each pair of a first and a second warp thread system lying alongside one another, in the first warp thread system, n/2 figure warp threads are allocated to the top fabric, and n/2 other figure warp threads are allocated to the bottom fabric, and in the second warp thread system, n/2 figure warp threads with the same appearance as the figure warp threads that were allocated to the bottom fabric in the first warp thread system are allocated to the top fabric, and n/2 figure warp threads with the same appearance as the figure warp threads that were allocated to the top fabric in the first warp thread system are allocated to the bottom fabric.

23. The face-to-face weaving machine according to claim 22, characterized in that n=8 and that the eight figure warp threads of each pair of a first and a second warp thread system lying alongside one another are allocated to the fabrics according to one of the following allocation plans, whereby the allocation of each of these eight figure warp threads with first, second, third, . . . eighth appearance is always indicated in each allocation plan for both warp thread systems in the same order by means of a sequence of eight letters T or B, where T indicates the top fabric and B the bottom fabric:

| Allocation | First warp thread system | | | | | | | | Second warp thread system | | | | | | | |
|---|---|---|---|---|---|---|---|---|---|---|---|---|---|---|---|---|
| plan | 1 | 2 | 3 | 4 | 5 | 6 | 7 | 8 | 1 | 2 | 3 | 4 | 5 | 6 | 7 | 8 |
| A | T | B | T | B | B | T | B | T | B | T | B | T | T | B | T | B |
| B | T | T | T | T | B | B | B | B | B | B | B | B | T | T | T | T |
| C | T | T | B | B | B | B | T | T | B | B | T | T | T | T | B | B |
| D | B | T | T | B | B | T | T | B | T | B | B | T | T | B | B | T. |

24. The face-to-face weaving machine according to claim 19, characterized in that it is provided for operation with a method comprising in each consecutive weft insertion cycle on the face-to-face weaving machine, inserting one or more weft threads into a shed between warp threads of a number of warp thread systems lying alongside one another, wherein each warp thread system comprises one or more figure warp threads and each figure warp thread is allocated to one of the fabrics, positioning the warp threads in each shed in such a way that two fabrics are woven above one another with at least one zone in which each figure warp thread corresponding to a desired pattern is either pattern-determining in the fabric to which this figure warp thread is allocated or is incorporated into that fabric in a non-pattern-determining way, wherein in at least one pair of two warp thread systems lying alongside one another, providing at least one set of two figure warp threads with the same appearance, whereby the figure warp threads with the same appearance of each set belong to a different warp thread system of the pair and are, respectively, allocated to a different fabric, so that for each set of two figure warp threads with the same appearance, per pair of warp thread systems, a figure warp thread with said appearance is available in both fabrics to determine the pattern in said zones.

25. A fabric that is at least partially pile-free and in which one or more figure warp threads determine a pattern, wherein the fabric is woven according to the method according to claim 1.

* * * * *